US005474115A

United States Patent [19]

Fink, Jr.

[11] Patent Number: 5,474,115

[45] Date of Patent: Dec. 12, 1995

[54] SPECIALTY FUEL DISPENSING NOZZLE

[75] Inventor: Arthur C. Fink, Jr., Lonedell, Mo.

[73] Assignee: Husky Corporation, Pacific, Mo.

[21] Appl. No.: 285,818

[22] Filed: Aug. 4, 1994

[51] Int. Cl.[6] ..... B65B 31/00

[52] U.S. Cl. ..... 141/206; 141/392; 141/DIG. 1; 251/65

[58] Field of Search ..... 141/206–229, 141/392, DIG. 1, 302, 307, 308, 98, 198, 94, 96; 251/65; 137/522; 220/86.2

[56] References Cited

U.S. PATENT DOCUMENTS

| | | | |
|---|---|---|---|
| 3,148,713 | 9/1964 | Jones, Jr. | 141/DIG. 1 |
| 4,011,897 | 3/1977 | Hansel | 141/208 |
| 4,195,673 | 4/1980 | Johnston et al. | 141/DIG. 1 |
| 4,429,725 | 2/1984 | Walker et al. | 141/302 |
| 4,809,753 | 3/1989 | Fink, Jr. | 141/206 |
| 5,052,429 | 10/1991 | Yoo | 251/65 |
| 5,197,523 | 3/1993 | Fink, Jr. et al. | 141/206 |

*Primary Examiner*—Henry J. Recla
*Assistant Examiner*—Steven O. Douglas
*Attorney, Agent, or Firm*—Paul M. Denk

[57] ABSTRACT

A fuel dispensing nozzle has a vent tube extending through a spout of the nozzle and automatic shut off device in communication with, and responsive to, the passage of air through the vent tube. The vent tube terminates in an air port at the tip of the spout. A tip, forming a valve, is placed at the end of the vent tube. The valve has a magnetic responsive valve member and a seat formed at the junction of tip and the vent tube. The vacuum created by the nozzle seats the magnetic valve member against the seat to close the tube to activate the automatic shut off device. A vehicle which can accept the fuel being dispensed is equipped with a magnet in the neck of the fill pipe of the tank which will attract the magnetic valve member to hold the vent tube open, so that the automatic shut off device will not be activated by a closed valve member and fuel can be dispensed to the vehicle.

10 Claims, 2 Drawing Sheets

SPECIALTY FUEL DISPENSING NOZZLE

BACKGROUND OF THE INVENTION

This invention relates to fuel dispensing nozzles, and in particular, to nozzles which will permit the flow of specialty fuels only to vehicles which can accept such specialty fuels.

Some vehicles are designed to operate only with specialty fuels, such as M85, for example. Such specialty fuels should not be dispensed into vehicles which cannot accept these fuels. If the inappropriate fuel were dispensed into the vehicle, the vehicle motor may be damaged. Although devices are known which will shut off the flow of fuel to a vehicle, there is no known commercially available device which can sense whether or not a vehicle can accept the specialty fuel and prevent dispensing of the fuel to vehicles which cannot accept the fuel.

SUMMARY OF THE INVENTION

One object of the present invention is to provide an improved fuel dispensing nozzle.

A second object is to provide such a nozzle which can determine if a vehicle can accept the fuel being dispensed through that nozzle.

A third object is to provide such a nozzle which will prevent the flow of the fuel through the nozzle if it is determined that the vehicle cannot accept the fuel dispensed by the nozzle.

Another object is to provide such a nozzle which is reliable and simple to operated.

These and other objects will become apparent to those skilled in the art in light of the following disclosure and accompanying drawings.

Briefly stated, an improved fuel dispensing nozzle is provided. The nozzle can be a vacuum assist or balanced pressure type fuel dispensing nozzle having automatic shut off means and a vent tube extending through a spout of the nozzle. The vent tube terminates in a vent or air port at the tip of the spout. A tip, forming a valve, is placed at the end of the vent tube. The valve has a magnetic valve member and a seat formed at the junction of tip and the vent tube. The vacuum created by the nozzle seats the magnetic valve member against the seat to close the tube to activate the automatic shut off means. A vehicle which can accept the fuel being dispensed is equipped with a magnet in the neck of the tank which will attract the magnetic valve member to hold the vent tube open, so that the automatic shut off means will not be activated and fuel can be dispensed to the vehicle. The magnetic properties of the magnetic valve member and the magnet in the fuel tank could be altered so that the tip will be normally open and the magnet is placed at the fill pipe of the tank of a vehicle which cannot accept the fuel to close the vent tube when a user attempts to dispense fuel into the car with the magnet.

DESCRIPTION OF THE PREFERRED EMBODIMENT

Figure 1:
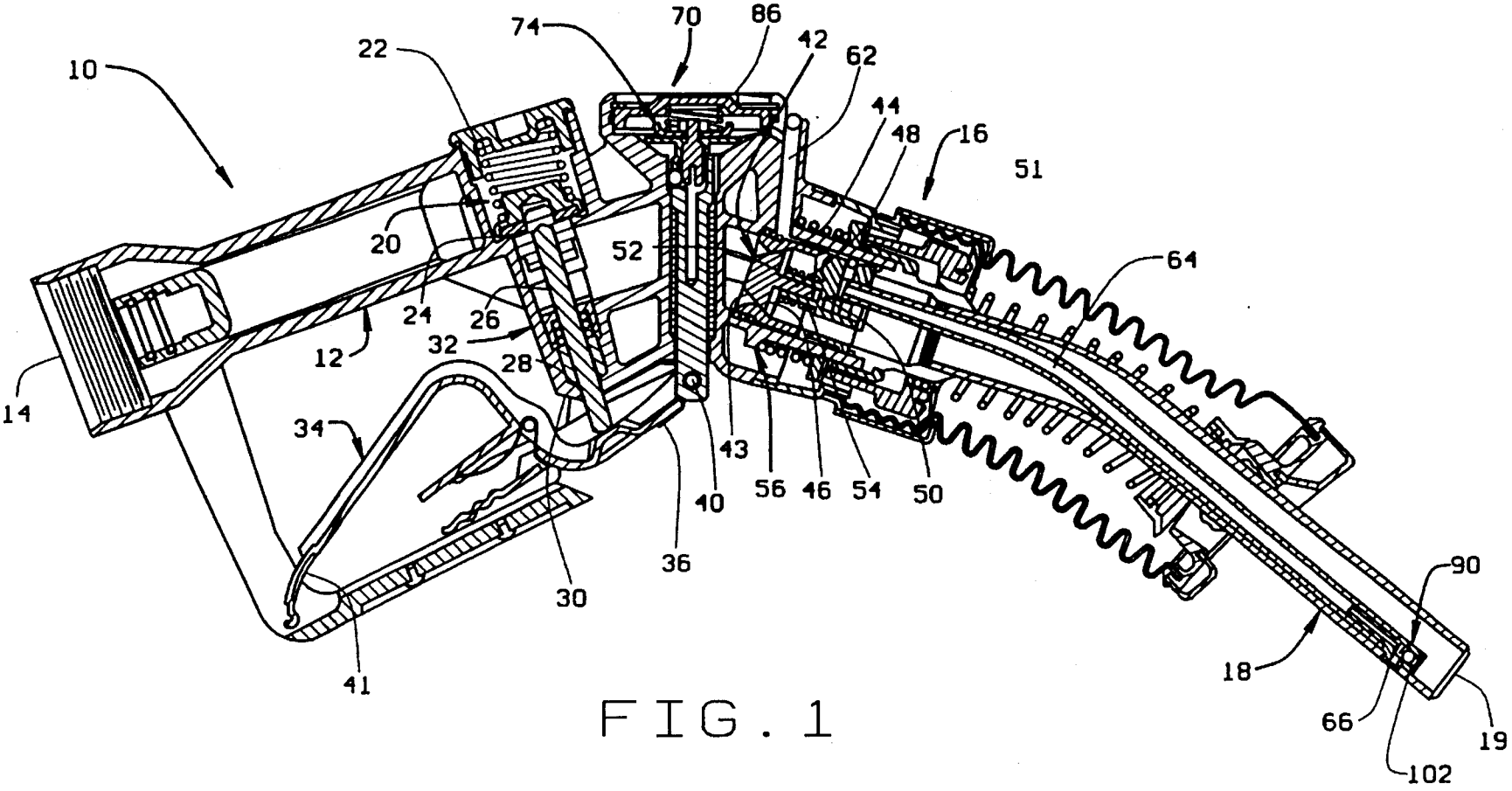
FIG. 1 is a cross-sectional view of a fuel dispensing nozzle incorporating the present invention.

Referring to the drawings, a nozzle for dispensing liquids such as gasoline, diesel fuel or the like is indicated generally at 10. The nozzle can be a standard dispensing nozzle, or any of the vapor recovery nozzle type, such as a vacuum assist, or a balanced pressure type, as shown in FIG. 1. The nozzle includes a body 12 having an inlet 14 to which a fuel hose (not shown) is connected. The nozzle also has an outlet 16 communicating with a spout assembly 18. Assembly 18 has a mouth 19 which is insertable into the fill pipe N of an automobile fuel tank T (FIG. 2) Disposed within body 12, between the inlet and outlet, is a poppet valve 20. This valve is biased by a spring 22 into sealing engagement with a poppet valve seat 24. Popper 20 is secured to the upper end of a valve stem 26. The valve is located in the upper portion of body 12, and the valve stem extends downwardly through the body. The lower end of the stem projects through an opening 28 in the base 30 of a body section 32. An operating lever 34 for the nozzle has one end 36, its pivoting functional end, connected to the lower end of an automatic shut-off plunger 38 by, for example, a pin 40. The other end 41 of the lever is grasped by the hand of a user, and when squeezed, the upward pressure on the lever forces valve stem 26 upwardly. This moves valve 20 off valve seat 24, opening the valve, and permitting fuel flow through the nozzle.

Adjacent outlet 16 of the nozzle, in the flow path through body 12, is a variable venturi 42. A spring loaded check valve 43 is positioned in the venturi, on the downstream side thereof, to control fuel flow into the outlet, and to the spout. The check valve has a valve body 44 which is frustoconically shaped and fits into the flow restriction formed by the venturi. Extending from the underside 46 of the valve body is a valve stem 48. This stem is slidingly received in a cylindrically shaped valve guide 50 which projects inwardly into the outlet from an interior wall portion 51 of the spout assembly. An annular groove 52 is formed in an underside 46 of the valve body, adjacent stem 48, and extends upwardly into the valve body. The width of this groove is sufficient for a spring 54 to both fit into the groove and seat against the base thereof. Spring 54 also seats against the base of guide 50. When valve 20 is opened, the rush of fuel through the nozzle body unseats the check valve so fuel can flow through the venturi 42 to the nozzle spout and outlet. The flow rate is a function of the extent to which valve 43 is pushed downstream against the force of spring 54.

Venturi 42 is installed in a circular housing 56 which defines the outlet 16.

When tank T is substantially full, it is desirable to terminate flow of fuel though the nozzle so to not overfill the tank. An automatic shutoff assembly 70 is therefor provided. Shutoff assembly 70 is explained in detail in U.S. Pat. No. 5,197,523, which is incorporated herein by reference. The shutoff assembly 70 is controlled, in part, by a diaphragm assembly 74. A chamber 86 is defined above diaphragm assembly 74 which is connected the venturi by an air passage 62. When fuel flows over the venturi 42, a partial vacuum is created that is communicated to chamber 86 via passage 62.

Figure 2:
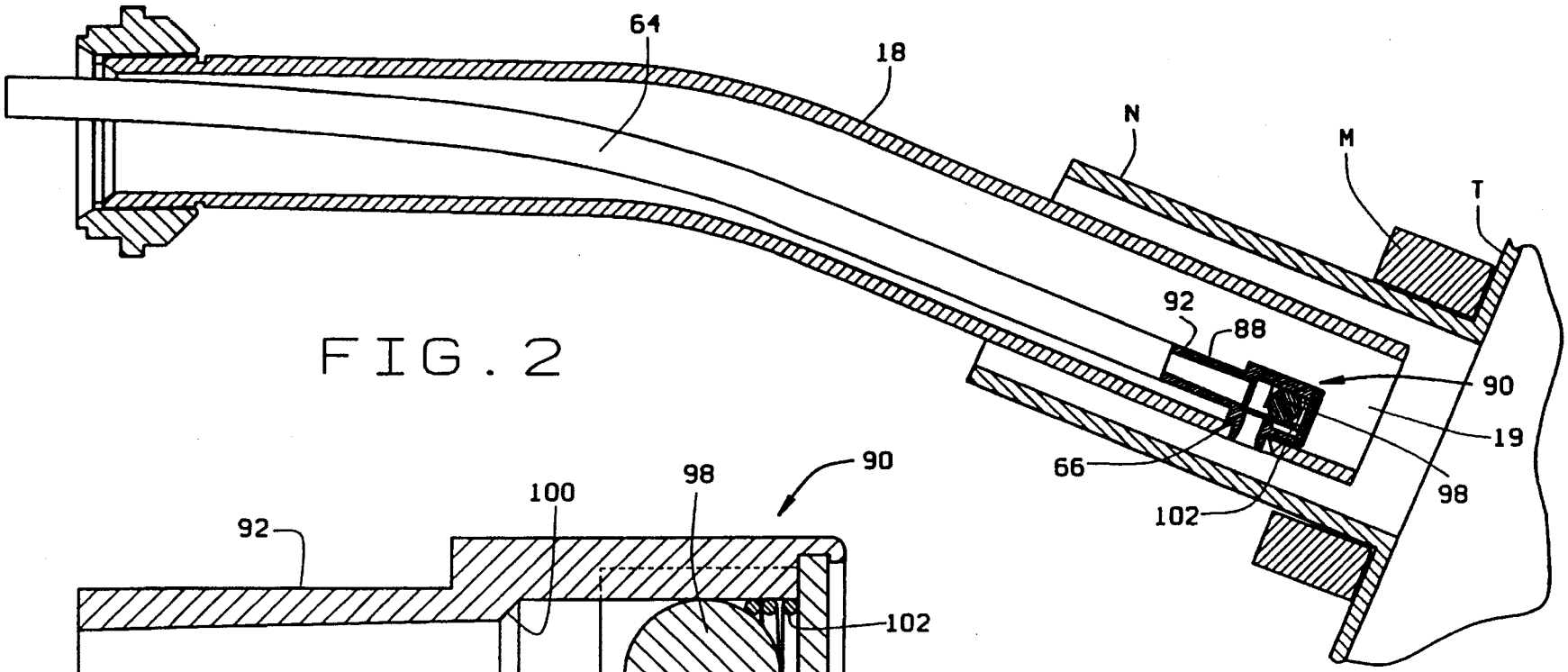
FIG. 2 is a cross-sectional view of a nozzle of the fuel dispensing nozzle inserted in a vehicle's fuel tank.

Turning to FIG. 2, a vent tube 64 is received in spout 18 and is in fluid communication with air passage 62. The vent tube is of a much smaller diameter than the spout 18 and has a length that is less than the spout so that the vent tube terminates short of the mouth 19 of the spout. An opening air hole 66 is formed at the outer end of the spout adjacent its mouth, as is known. The outer end 68 of the vent tube is located adjacent this opening so air flowing into the spout through the opening flows through the vent tube. Because the vent tube is operatively connected to the air passage 62, when the venturi creates a vacuum, air is drawn through the vent tube, dissipating the generated vacuum, prevents its build up in chamber 86, preventing the operations of the automatic shut-off. As described in the above noted patent, when the vent tube is closed, or sealed off, the automatic shut off system is operated, to effect closing of the poppet, to prevent the further flow of fluid through the nozzle.

The vent tube is fitted with a cover or tip 90. Tip 90 has a neck 92 which fits within the vent tube to hold the tip to the vent tube and a body into which the tip neck opens. The body has an opening 94 or port which is placed in communication with the air opening 66 in the spout. The port has a neck 96 which is received in the air opening 66 so that the cap, and hence the vent tube, will be fixed in place within the spout.

The tip body defines a valve having a valve member or ball 98 movable within the body and a valve seat 100 defined by the junction of the tip neck and the tip body. The valve member 98 is preferably a magnetic ball. When the nozzle 10 is operated, the suction created by the venturi, which creates a vacuum in air line 64, pulls ambient air through this valve, allows the nozzle to dispense gas, and prevents the function of the automatic shut-off. But, when the tank fills, fuel reaches the port 94, and air flow through vent tube 64 will stop and the automatic shut off mechanism will be activated to stop the flow of fuel through the nozzle.

Figure 3:
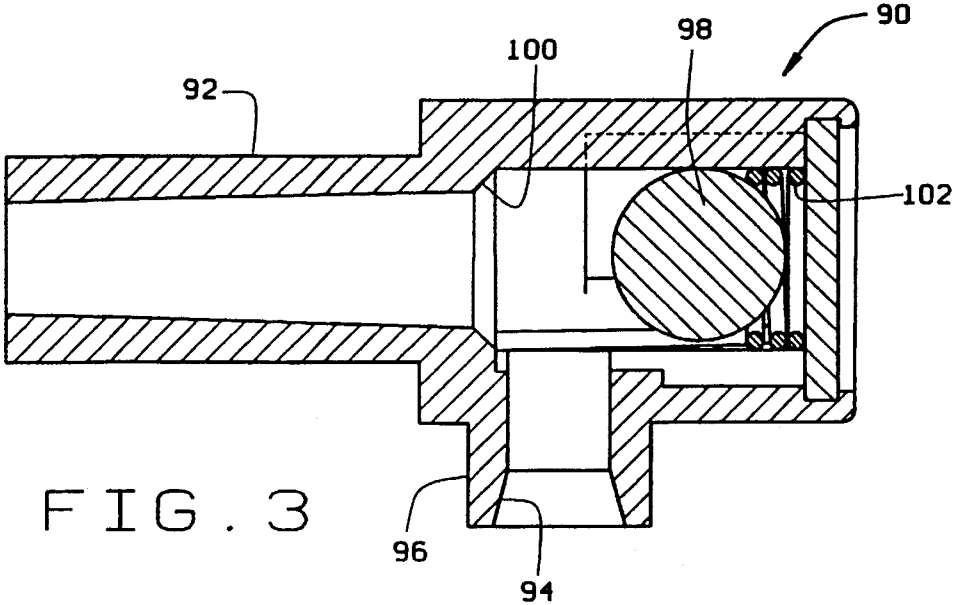
FIG. 3 is an enlarged view of a tip assembly which prevents the flow of fuel through the nozzle.

But, for purposes of this invention, vehicles which can accept the specialty fuel being dispensed by a particular dispenser may have a magnet M positioned around the neck of their fill pipe N, in such a position that the magnetic field produced by the magnet will attract the valve member or ball 98 down, or forwardly within its spout, to maintain the valve in an opened condition. Thus, under these circumstances, the vent tube 64 remains opened, allowing the dispensing of the specialty fuel, until such time as the fuel closes off the port 94, thereby activating the automatic shut-off mechanism, and requiring the nozzle to instantly cease the dispensing of fuel. Without the use of such a magnet, the ball valve 98 may be attracted by the vacuum that is generated within the tube 64, as a result of the partial vacuum generated within the venturi 42, and thereby instantly close off the ball valve 98, to prevent the dispensing of fuel by the nozzle. In addition, it is likely that a spring, such as one shown at 102, could continuously bias the ball valve 98 against its seat 100, to prevent the dispensing of fuel from the nozzle, until such time as a magnet is encountered, as the spout is inserted within the fill pipe N, to hold the ball forwardly, at the position as shown in FIG. 3, to allow the routine dispensing of fuel, until such time as the fuel tank fills, and closes off the port 94. Thus, the magnetic ball is responsive to the presence or absence of a magnetic field to close the vent tube when the spout is placed in the tank of a vehicle which cannot accept the type of specialty gas being dispensed by the nozzle. The magnet M may be a permanent magnet, or an electromagnet, which is activated by a switch in the neck which is actuated by the insertion of the nozzle spout into the tank fill pipe. On the other hand, a permanent magnet will likely work without necessitating the presence of any electrical means in conjunction with the dispensing of volatile fuels. As can be appreciated, vehicles which cannot accept the specialty fuel being dispensed by this nozzle are not equipped with such a magnet, and therefore, the valve member or ball 98 will either be spring biased into closure, preventing the dispensing of fuel, or when fuel dispensing commences, the nozzle will be immediately shut off, due to the ball 98 being attracted through the generation of the partial vacuum towards seating against its valve seat 100, to immediately activate the automatic shut-off mechanism for curtailing the dispensing of fuel through the nozzle. Because such vehicles are not equipped with a magnet, the shut-off system will be immediately activated, as described above, and specialty fuel will not be dispensed undesirably into the vehicle.

Obviously, the nozzle can also be configured so that the magnetic field is produced by a car which cannot accept the fuel dispensed by the nozzle. The magnetic ball and the magnetic field would be of the same polarity so that the magnetic field repels the ball. The repelling force of the magnets would cause the ball to seat against the tip valve seat, closing off the vent tube, and activating the automatic shut off system.

As can be appreciated, a vacuum type nozzle is disclosed which can determine when a vehicle can accept the type of fuel dispensed by the nozzle. When the vehicle detects that the vehicle will not accept the fuel, it automatically shuts down and prevents the flow of fuel to the vehicle.

Variations within the scope of the appended claims may be apparent to those skilled in the art. The foregoing description is thus illustrative only, and is not to be taken as limiting.

I claim:

1. In a fuel dispensing nozzle for dispensing specialty fuel from a storage tank to a vehicle fill pipe and fuel tank, the dispensing nozzle having a body and a spout insertable into a neck of the fuel tank; said spout having an air port at a distal end thereof; a fuel flow path for dispensing fuel from the storage tank to the vehicle tank; a poppet valve in said fuel flow path, said poppet valve movable between a closed position in which fuel cannot flow through the flow path and an open position in which fuel can flow through the flow path; a venturi including a venturi port in communication with said fuel flow path, and a vent tube extending from said venturi port to said air port, said tube having an opening in communication with said air port, said venturi creating a vacuum which pulls air through said vent tube when fuel flows through said flow path; automatic shut off means for closing said valve, said automatic shut off means being responsive to the lack of flow of air through said vent tube; the improvement comprising a sensor in said nozzle for detecting the presence of a magnetic force at said vehicle fill pipe, said sensor being operable to close said vent tube to effect a prevention in the dispensing of fuel to vehicles which cannot accept the dispensed type fuel.

2. The improvement of claim 1 wherein said sensor includes a hollow tip secured to the end of said vent tube, said tip including a port in communication with said nozzle air sensing port; said hollow tip including a valve defining a magnetic sensitive valve member sized to close said vent tube; a magnet included for producing a magnetic field which surrounds said magnetic sensitive member when said nozzle is inserted into a fuel tank fill pipe; said magnetic valve member being responsive to the presence of said magnetic field to close said venturi tube to prevent the flow of fuel to vehicles which cannot accept said fuel.

3. The improvement of claim 2 wherein said tip valve seat is defined by a junction of said vent tube tip and said vent tube, said magnetic valve member being a ball valve and normally seated against said seat to close said vent tube, said magnetic field attracting said magnetic sensitive ball member to unseat said valve member, and to allow the dispensing of fuel.

4. The improvement of claim 3 wherein said ball valve member is biased closed by a spring, and held open by the magnetic field to provide the dispensing of specialty fuel from the the nozzle.

5. The improvement of claim 3 wherein said ball valve member is biased closed by the venturi generated vacuum created in said vent tube when fuel flows through said flow path, and held open by the magnetic field to provide the dispensing of specialty fuel from the nozzle.

6. The improvement of claim 2 wherein said tip valve member is biased to be normally unseated, said magnetic field repelling said magnetic valve member to seat said valve member when said magnetic field is present.

7. In combination, a vehicle having a fuel tank and a specialty fuel dispensing nozzle;

the fuel tank having a neck with a magnet surrounding at least a portion of said neck;

said fuel dispensing nozzle being a vacuum assist nozzle which creates a vacuum when fuel flows through the nozzle and having a spout which is receivable in the fuel tank neck to reach at least to said magnet, an air port at a distal end of said spout, a vent tube extending through said spout and having an end in communication with said air port, said vacuum created by said nozzle drawing air through said vent tube, and automatic shut off means in communication with said vent tube and responsive to the flow of air through said vent tube for stopping the flow of fuel through said nozzle when the flow of air through said vent tube is stopped; and valve means provided proximate said air port and responsive to the presence of said magnet in said neck to prevent the flow of fuel to a vehicle which cannot accept the specialty fuel dispensed by the nozzle.

8. The combination of claim 7 wherein said valve means includes a ball valve in said vent tube, said valve means also including a valve body having a valve seat, said ball valve being magnetic, said ball valve located within said valve body, said ball valve being positioned in said spout so that it is surrounded and influenced by the magnetic field of said fuel tank magnet.

9. The combination of claim 8 wherein said vehicle is a vehicle which can accept the fuel dispensed by said nozzle, said vent tube ball valve being normally closed by said vacuum, said vacuum seating said ball valve member against said valve seat to close said vent tube and activate said automatic shut off mechanism, said fuel tank neck magnet attracting and unseating said ball valve member to maintain said vent tube open during routine fuel dispensing.

10. The combination of claim 8 wherein said vehicle is a vehicle which cannot accept the specialty fuel dispensed by said nozzle, said nozzle being normally opened, said magnetic ball valve and said fuel tank magnet being of the same polarity, said fuel tank magnet repelling said ball valve to seat said ball valve and close said vent tube to activate said automatic shut off mechanism and prevent the dispensing of fuel.

* * * * *